US006062341A

United States Patent [19]

Frank et al.

[11] Patent Number: 6,062,341

[45] Date of Patent: May 16, 2000

[54] GUARD RAIL STUD ADAPTER

[75] Inventors: Roger Frank, New Berlin; Robert M. Reilly, Pewaukee; Stig Karlsen, Burlington, all of Wis.

[73] Assignee: Safway Steel Products Inc., Waukesha, Wis.

[21] Appl. No.: 09/151,875

[22] Filed: Sep. 11, 1998

[51] Int. Cl.[7] ..... E04G 7/22

[52] U.S. Cl. ..... 182/113; 182/186.8; 403/49

[58] Field of Search ..... 182/186.7, 186.8, 182/178.1, 179.1, 113; 403/49

[56] References Cited

U.S. PATENT DOCUMENTS

| | | | |
|---|---|---|---|
| 2,249,658 | 7/1941 | Kemner | 304/2 |
| 2,698,552 | 1/1955 | Smith | 85/3 |
| 2,701,167 | 2/1955 | Kirkpatrick | 304/2 |
| 2,832,649 | 4/1958 | Chadwick | 304/40 |
| 3,270,997 | 9/1966 | Gethmann | 248/235 |
| 3,392,801 | 7/1968 | Gethmann | 182/178 |
| 3,662,993 | 5/1972 | Lionetto | 256/65 |
| 3,751,081 | 8/1973 | Schimmel et al. | 287/53.5 |
| 3,867,043 | 2/1975 | Plough | 403/49 |
| 4,004,393 | 1/1977 | Morris | 52/637 |
| 4,111,579 | 9/1978 | Knight | 403/387 |
| 4,430,019 | 2/1984 | D'Alessio | 403/409 |
| 4,445,307 | 5/1984 | Puccinelli et al. | 52/638 |
| 4,586,842 | 5/1986 | Puccinelli | 403/246 |
| 4,787,475 | 11/1988 | Arteau et al. | 182/82 |
| 5,145,030 | 9/1992 | Pavlescak et al. | 182/113 |
| 5,186,568 | 2/1993 | Falardeau | 403/49 |
| 5,362,030 | 11/1994 | Iler, Jr. et al. | 256/65 |
| 5,683,074 | 11/1997 | Purvis et al. | 256/67 |

*Primary Examiner*—Alvin Chin-Shue
*Attorney, Agent, or Firm*—Whyte Hirschboeck Dudek S.C.

[57] ABSTRACT

An attachment device for a scaffolding system which includes vertical and horizontal tubes is comprised of a guard rail stud adapter and a first stud. The guard rail stud adapter includes a generally U-shaped member which has a base portion, a first arm connected to the base portion, and a second arm connected to the base portion. At least one of the arms may include an end which has an arcuate cut-out portion for receiving vertical tubes. A second stud is connected to the generally U-shaped member for retaining scaffolding members, such guard rails or other members. A generally l-shaped member connected to the U-shaped member has a first end connected to at least one arm and a hole for receiving the first stud of the scaffolding system. One embodiment is further comprised of a spacer having a counter-bore for receiving the second stud of the scaffolding. Tile spacer is connected between the second stud and the generally U-shaped member. The generally U-shaped member may have a hole aligned with the counter-bore of the spacer. The counter-bore and the hole are dimensioned to receive the second stud. A locking wing latch may be swingably connected to at least one stud to retain the cross braces and the guard rails. The locking wing latch includes a wing having a hole and a roll pin for swingably connecting the wing to the stud. A pair of legs may be connected to the generally U-shaped member. Ribs and gussets may be integral with the generally U-shaped member for reinforcing the adapter. A pair of feet may extend outwardly toward the scaffolding system from the arms to embrace the vertical tubes of scaffolding system.

13 Claims, 10 Drawing Sheets

GUARD RAIL STUD ADAPTER

BACKGROUND OF THE INVENTION

1. Field of the Invention

This invention relates in general to scaffolding and shoring systems such as those used by building contractors, maintenance, repair personnel and others who are required to work on, build, paint and/or repair buildings and other structures. More particularly this invention relates to an attachment stud adapter for a safety guard rail for a conventional scaffolding or shoring system.

2. Discussion of Related Art

Conventional scaffolding or shoring(g systems have two spaced apart upright members secured in proper upright position by side crossed braces. In scaffolding systems, floor boards extend between the upright members and set upon horizontal supports provided on each upright member so that workers can stand and work on the stable, elevated, temporary flooring. however, workers and equipment still occasionally, for one reason or another, fall through the unprotected open space between the floor and the crossed braces of the scaffolding, resulting in serious injury. Consequently, OSHA, a federal regulatory health and safety agency, has imposed regulations on the industry that require suitable safety guard rails be installed on scaffolding systems to obstruct the open spaces between the braces.

In conventional shoring and scaffolding arrangements, the vertical support elements often are reinforced and stabilized by the use of additional crossed braces extending between them. Typically, these braces are secured to the vertical supports by bolt and nut assemblies with the bolts or studs, typically being welded or otherwise rigidly secured in fixed positions to the vertical support. With such arrangements, there has been at best difficult and limited flexibility in the positioning of the connection between the brace and the support.

Consequently. conventional guard or safety rail constructions have their drawbacks. For example, installation of safety rails is often difficult, time consuming and frustrating because of typical, minor dimensional variations in scaffolding systems. Furthermore, workers often quickly assemble the scaffolding system high above the ground. Thus, complex guard rails and attachment devices increase the likelihood of an accident in such an environment. Complex attachment devices are also more likely to jam, or become nearly impossible to remove, when they become dirty or when corrosion sets in. Therefore, workmen commonly ignore the installation of safety guard rails, despite the federal requirements for their installation. Moreover, conventional scaffolding systems do not have retaining studs long enough to secure both the required cross braces and guard rails.

One previously recognized solution, such as a guard rail which has C-shaped attachment clamps, has the disadvantages of not being universal enough for all applications and having a multitude of moving parts and a relatively high cost.

The below-referenced U.S. patents disclose additional solutions that were at least in-part satisfactory for the purposes for which they were intended. The disclosures of all the below-referenced prior United States patents, in their entireties are hereby expressly incorporated by reference into the present application for purposes including, but not limited to, indicating the background of the present invention and illustrating the state of the art.

U.S. Pat. No. 4,004,393 discloses a shoring or scaffold system which uses demountable stacked scaffold sections, each having a pair of spaced-apart end frames that are demountably cross-connected with respect to each other. To provide strength and support rigidity, vertically adjustable, bracing members are utilized to extend from the end frame of a lower section across and in an interconnecting relation with an opposed end frame of an upper section. These bracing members have at one end a pivot mounting which connects to a horizontally extending connecting member of a frame of one section and at the other end have a latching arm which is provided with a group of spaced-apart latching holes. The latching holes latch with a single latching pin and latch keeper element which are attached to a secondary leg member of the opposed frame.

U.S. Pat. No. 5,145,030 discloses a guard rail post comprised of an elongated member having securing means comprised of a U-shaped channel and a post pin for securing a guard rail post to a vertical support member of the scaffold, positioning means for mounting the guard rail post in fixed relationship to a scaffold work platform, and connecting means which includes pins having flip locks for connecting guard rails to the post at a fixed distance above the work platform.

U.S. Pat. No. 4,430,019 discloses a wedge-and-bolt connector assembly for adjustably fixing a stud to a slotted thin-walled structure or the like for use in a scaffolding or shoring system to connect braces to vertical support elements. The support elements have T-slotted channels formed therein. The connector assembly includes a stud having a T-shaped head adapted to be received in a channel and a shank extending through a channel slot away from the head. The stud shank is formed of two parts, a stud section and a connector or extension section threadedly engaged to the stud section. The free end of the stud extension section may have a toggle thereon for securing the brace to the stud shank. In lieu of the toggle, a wedge may be provided with an L-shaped slide-lock extension having a first leg and a second leg. A free end of the stud is adjacent to the leg when in the locking position.

U.S. Pat. No. 4,111,579 discloses a scaffold fitting attached to a scaffold tube which has a generally U-shaped clamping lever secured by a screw which passes through an intermediate aperture in the lever and which can be tightened to urge one end of the layer against a flanged member to clamp the latter directly against the scaffold tube. The free end of the lever has an arcuate abutment face which rests against the scaffold tube.

In embodiments disclosed in the above-referenced patents, a device for connecting additional members to scaffolding and/or shoring is disclosed. Nevertheless, these systems generally have the disadvantage that they do not work well with a multitude of conventional scaffolding and/or shoring systems. Further, as indicated above, these systems generally have the disadvantage that they are costly and complex to manufacture and operate.

What is needed therefore is device for attaching additional members, like guard rails, to existing scaffolding and/or shoring systems that is simple and easy to use in nearly any environment. Further, what is also needed is a cost effective attachment device for such systems.

SUMMARY AND OBJECTS OF THE INVENTION

By way of summary, the present invention is directed to attachment device or stud adapter for guard rails and the like. A primary object of the invention is to provide an apparatus that extends the existing length of a stud on most conventional scaffolding and/or shoring systems. Another object of the invention is to provide an apparatus that is ruggedized and reliable, thereby decreasing down time and operating costs. Another object of the invention is to provide an apparatus that has one or more of the characteristics discussed above but which is relatively simple to use and manufacture using a minimum of equipment and labor.

A further object of this invention is to provide a guard rail adapter of the class described which is dimensioned and configured to accommodate installation of additional members on the system despite typical dimensional variations common in conventional system constructions.

A further object of the present invention is to provide an attachment device which will permit two components to be connected to each other in a rapid and secure manner, without the need for tools.

In accordance with one aspect of the invention, these objects are achieved by providing an apparatus comprising a safety guard rail and attachment stud adapter for conventional system which allows the guard rail to be arranged to obstruct the open spaces between the cross braces and the flooring of the system in order to prevent workers from inadvertently falling therethrough. Along these lines, the inventive safety guard rail adapter is configured for attachment to the standard protruding stud of a conventional vertical or upright member of the system. The adapter is configured to extend the length of the existing attachment device.

In accordance with another aspect of the invention, these objects are achieved by providing a guard rail stud adapter, preferably consisting of a U-shaped member, an l-shaped coupling member connected to at least one arm of the U-shaped member, and a protruding stud having a locking wing. The stud adapter has a hole which is configured and dimensioned to receive an existing stud connected to a scaffold member. The existing stud may also pass into a slotted hole in the U-shaped member. The arms of the U-shaped member are configured and dimensioned to receive a tube of the scaffold. In the preferred embodiment, a semi-circular recess is provided in the arms for receiving a vertical tube of the system.

This invention is particularly useful because the existing studs on the system are not long enough to receive a multitude of cross beams which make up the structurally supporting crossed braces of the system and additionial guard rails which may be necessary to meet safety compliance regulations. With the inventive attachment device, paddles from the crossed braces or other members may fit on the existing stud, and additional paddles from the guard rails may be further attached to the second stud on the guard rail stud adapter. The attachment device also allows additional clearance for the radii of the cross braces and the guard rails. The inventive attachment device is a simple and inexpensive solution allowing for the attachment of guard rails or other members necessary to conform with regulations. The adapter also has minimal moving parts making it (a) easy to use at dangerous altitudes and (b) less likely to be jammed when corroded or encrusted with dirt or grease.

These, and other, aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention will become more readily apparent by referring to the exemplary, and therefore non-limiting, embodiments illustrated in the drawings accompanying and forming a part of this specification, wherein like reference numerals designate the same or similar elements in the several views and embodiments, and in which.

DESCRIPTION OF PREFERRED EMBODIMENTS

The present invention and the various features and advantageous details thereof are explained more fully with reference to the non-limiting embodiments described in detail in the following description.

Figure 1:
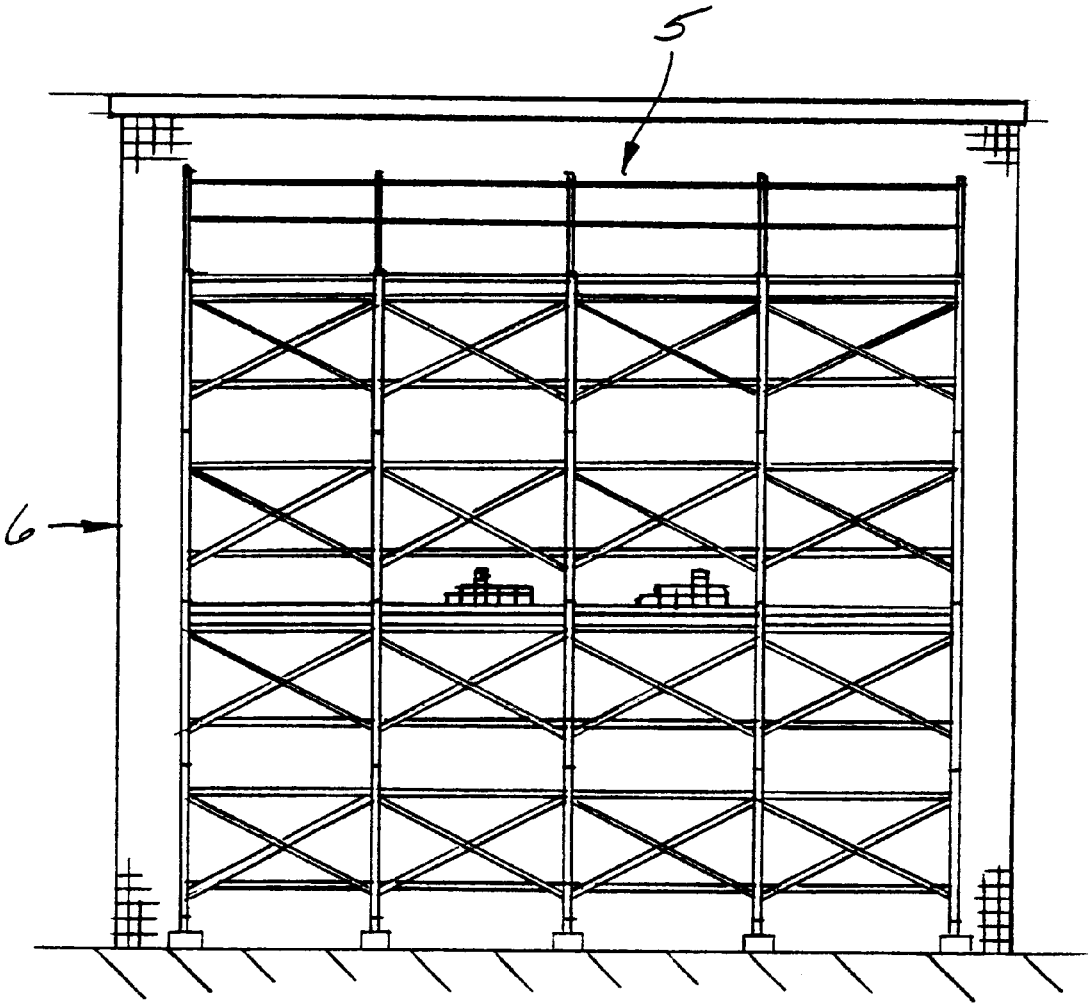
FIG. 1 illustrates a generally schematic view of a conventional scaffold system.
Figure 2:
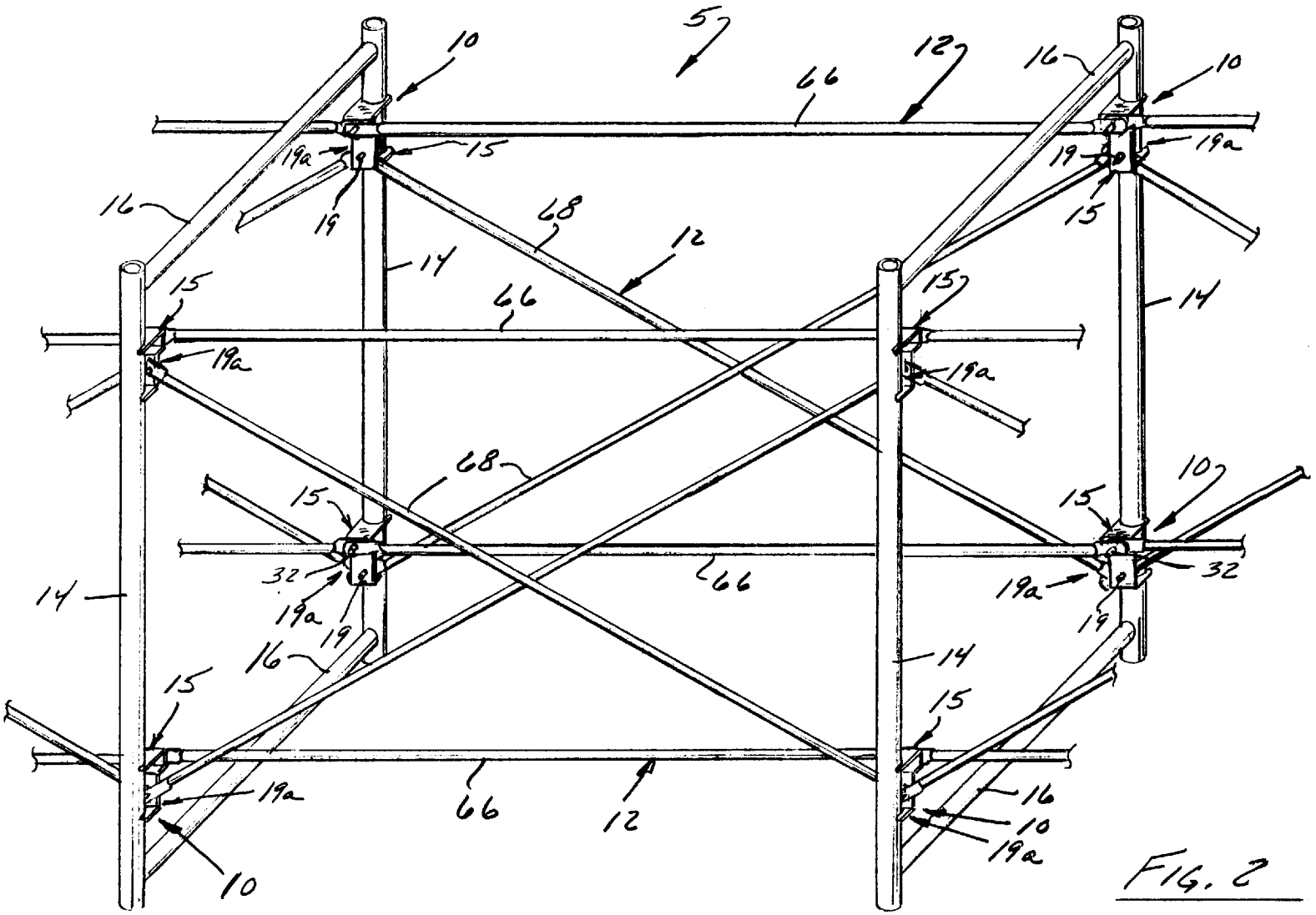
FIG. 2 illustrates a perspective view of a system according to the present invention.
Figure 3:
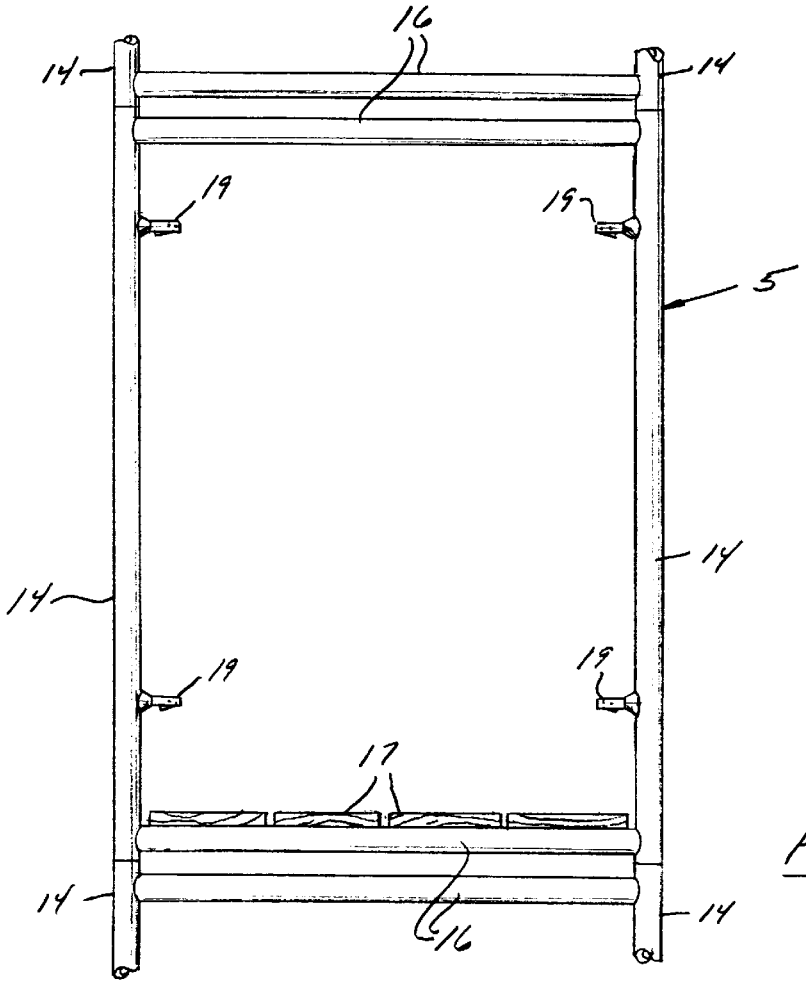
FIG. 3 illustrates a side view of the system of FIG. 2 with parts removed for clarity.

Referring generally to the drawings, FIGS. 1–17C, it can be seen that the present invention relates to scaffolding or shoring systems. Referring specifically to FIG. 1, a conventional system 5 is shown in use next to a building 6. As shown in FIG. 2, the system, 5 of the present invention is constructed of preferably round steel system members 12, vertical tubes 14, and horizontal tubes 16. Planks 17, preferably of wood, aluminum. or fiberglass, rest on the horizontal tubes 16 to provide support for workers or equipment, as shown in FIG. 3. Horizontal tubes 16 are preferably connected to vertical tubes 14 by welding.

Figure 4:
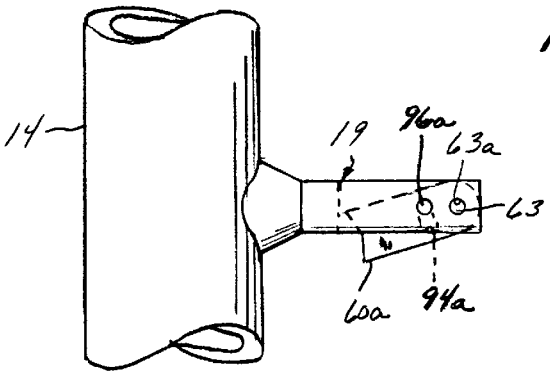
FIG. 4 illustrates an enlarged side view of a tube and a stud of the system shown in FIG. 3.
Figure 5:
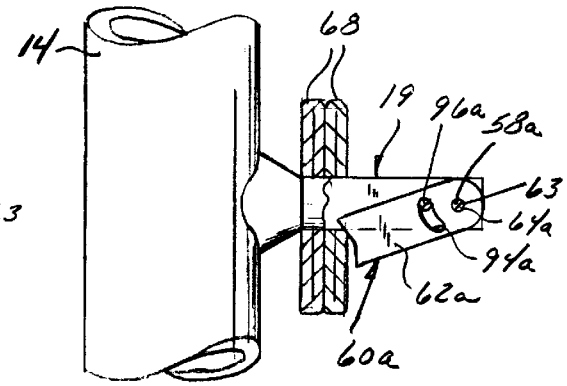
FIG. 5 illustrates a partially sectioned side view of system members retained on the tube and stud shown in FIG. 4.
Figure 6:
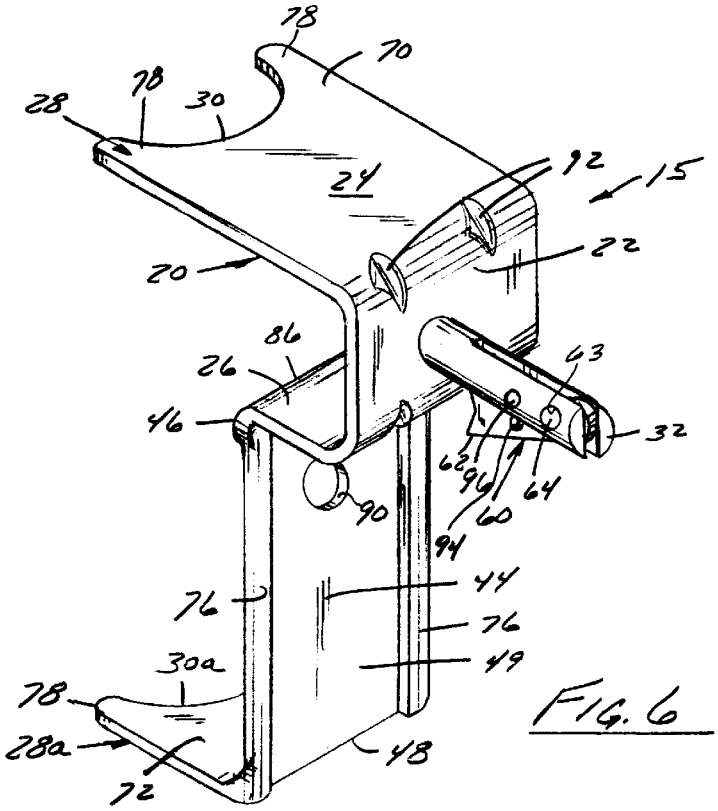
FIG. 6 illustrates an isometric view of one embodiment of an adapter according to the present invention.
Figure 7:
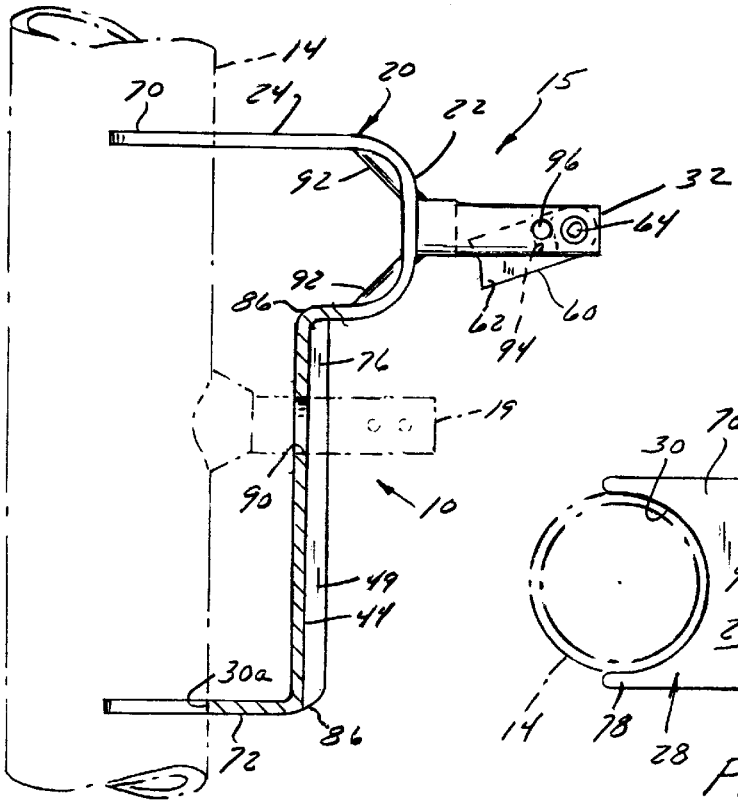
FIG. 7 illustrates a side view of the adapter of FIG. 6 attached to the tube and stud of FIG. 4 shown in shadow.

The inventive attachment device 10 of the system 5 includes first stud 19 and guard rail stud adapter 15 as best shown in FIG. 7. As best seen in FIGS. 4 and 5, first stud 19 preferably is made of metal and protrudes from vertical tube 14. First stud 19 is preferably connected to tube 14 by welding. First stud 19 is preferably formed by a cold forming process and then it is cut to the required length before it is welded to tube 14. As best shown in FIG. 2, stud 19 is preferably located at predetermined locations 19*a* on the scaffolding system 5. Guard rail stud adapter 15 is preferably constructed from steel and comprised of a generally U-shaped member 20 as shown in FIG. 6. Adapter 15 is primarily formed by bending the metal in a stamping or punching operation.

Figure 8:
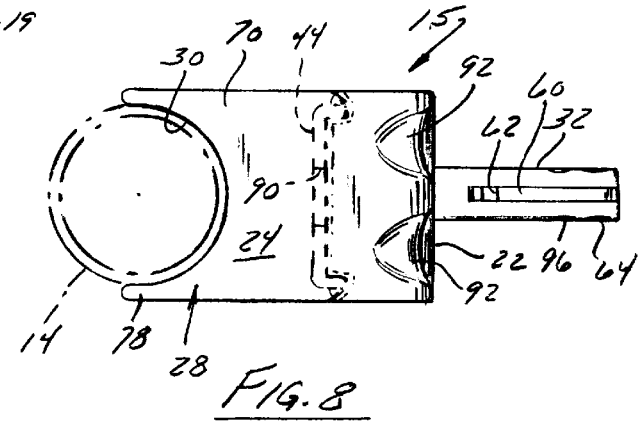
FIG. 8 illustrates a top view of the adapter of FIG. 7.

As best shown in FIG. 6, the generally U-shaped member 20 has a base portion 22, an extending first arm 24, and extending second arm 26. The arms 24, 26 preferably extend outwardly from the base portion 22. Preferably, the arms 24, 26 have ends 28, 28*a* which have cut-outs or recesses 30, 30*a* in a preferably arcuate or semicircular shape to receive the round tubes 14 of the system 5. FIG. 8 shows a top view of adapter 15 wherein recess 30 of first end 28 of arm 24 receives vertical tube 14. The recesses 30, 30*a* allow the U-shaped member 20 to hold the tube 14, thus increasing the stability of the member 20 and preventing the member from moving when a torque is applied.

Referring to FIG. 7, preferably protruding in a direction opposite of the first arm 24 and second arm 26 of the U-shaped member 20 is second stud 32. Second stud 32 is preferably constructed from metal and welded to base portion 22 of U-shaped member 20. However, one skilled in the art will realize that second stud 32 may be connected by some other means, for example, by threads as may be first stud 19.

First stud 19 preferably has a locking wing latch 60*a* which includes wing 62*a* which fits in a slot (not shown) as best shown in FIG. 5. Wing 62*a* has a hole 58*a* which receives roll pin 64*a*. Roll pin 64*a* is received in hole 63*a* in stud 19. The diameter of hole 58*a* in wing 62*a* is preferably slightly larger than the diameter of roll pin 64*a* to allow locking wing latch 60*a* to be swingably connected to the stud 19. Second pin 96*a* may fit into generally crescent-shaped hole 94*a* to further secure wing 62*a* to the stud 19. The crescent-shape of hole 94*a* gives wing 62*a* a significant swinging range of motion.

Figure 9:
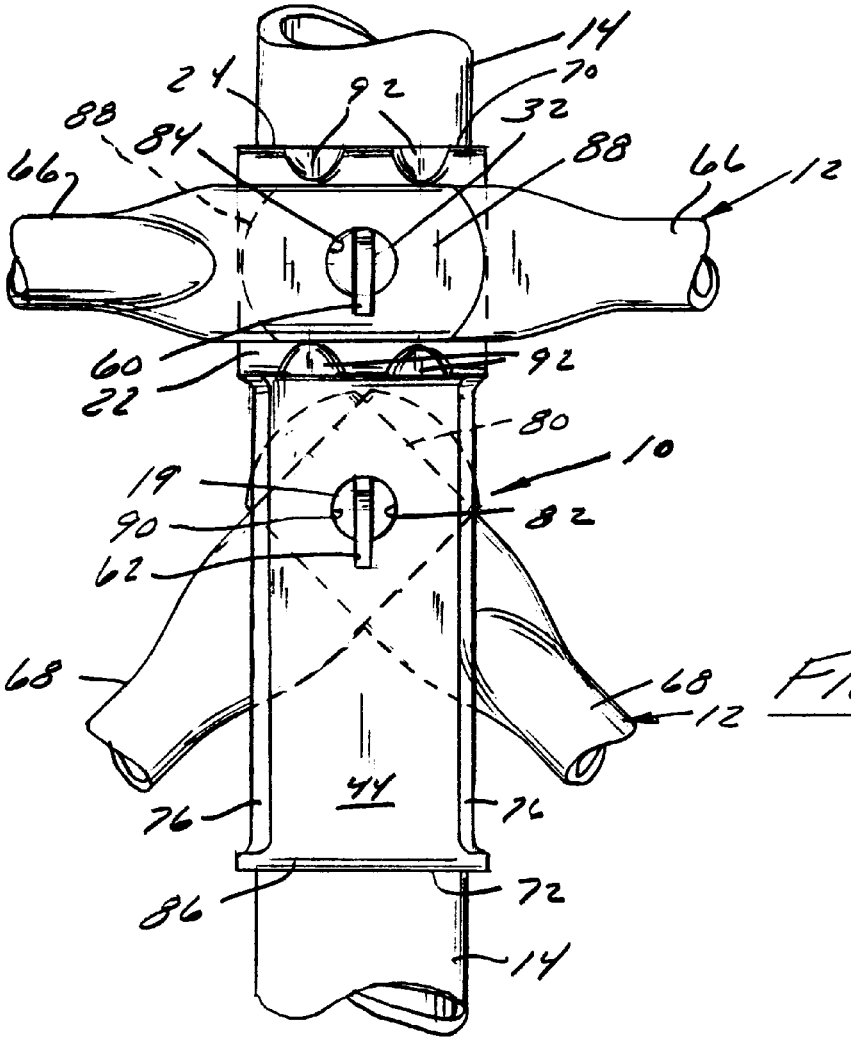
FIG. 9 illustrates a front elevational view of system members being retained by a stud on a tube and a stud on a stud adapter according to the present invention.
Figure 11:
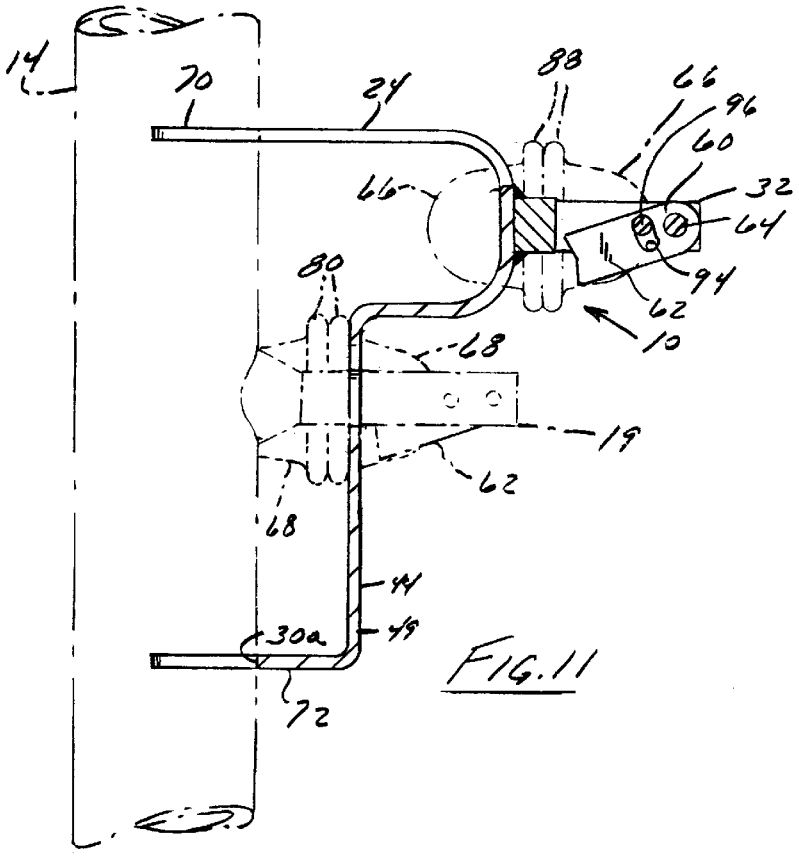
FIG. 11 illustrates a partially sectioned side view of the embodiment of FIG. 10 attached to a tube and retained by a stud shown in shadow.

A brace 68, or some other member 12 of the system 5 may be received by stud 19 and retained on stud 19 by locking wing latch 60*a* as shown in FIGS. 5, 9 and 11. A pair of crossed braces 68 obstruct open spaces in system 5 to prevent accidents.

Second stud 32 may have a locking wing latch 60 of a similar structure including a hole 63, a wing 62, a roll pin 64, a generally crescent shaped hole 94, a hole 53, and a second pin 96 as shown in FIG. 7. Second stud 32 receives guard rail 66. The locking wing latch 60 prevents removal of guard rails 66 and other like members 12.

Figure 12:
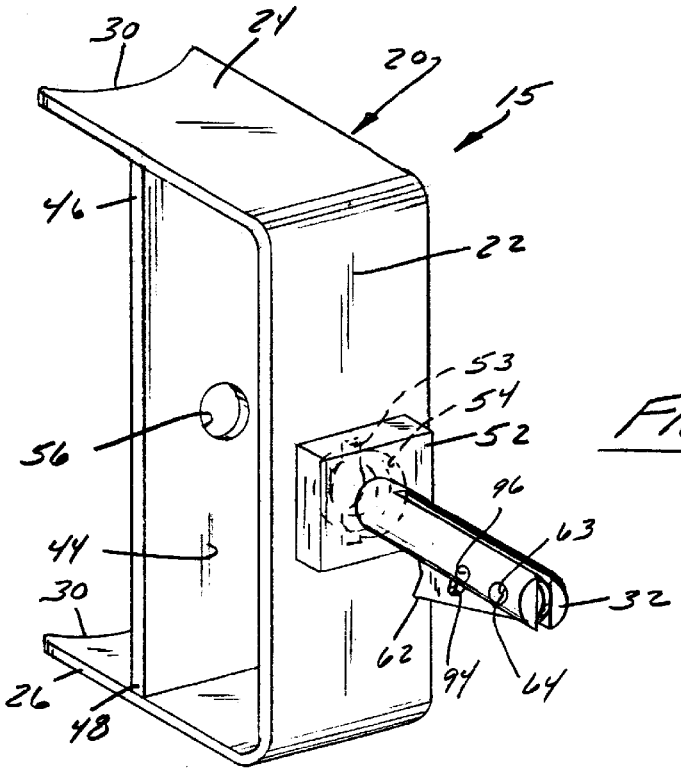
FIG. 12 illustrates an isometric view of another embodiment according to the present invention.
Figure 13:
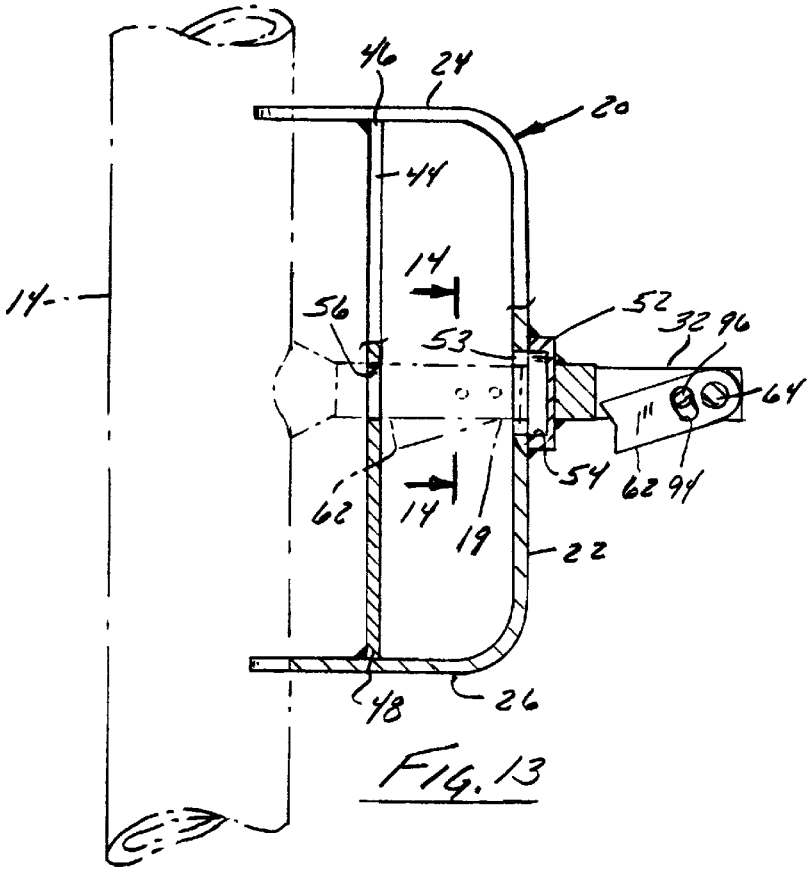
FIG. 13 illustrates a partially sectioned side view of the embodiment of FIG. 12 attached to a tube and a stud shown in shadow.
Figure 14:
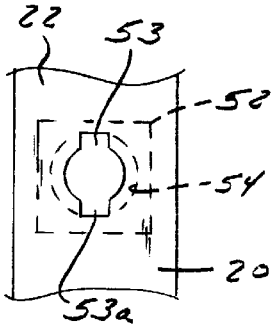
FIG. 14 illustrates a partial rear view of the embodiment of FIG. 13 taken from 14—14.

In the embodiment of the inventive adapter 15 shown in FIGS. 12–14, second stud 32 is first welded to generally square-scalped spacer 52 which is then preferably welded to U-shaped member 20. In this embodiment, U-shaped member 20 has hole 53 configured with a slot 53*a* for receiving wing 62 of first stud 19 as shown in FIGS. 13 and 14. Spacer 52 may have a counter-bore 54 which also dimensioned and configured to receive first stud 19 as best shown in FIG. 14.

Referring to the embodiment in FIGS. 12–14 a generally l-shaped coupling member 44 may be cut from a piece of sheet metal. Coupling member 44 has a first end 46 and a second end 48 which may be connected by welding to first arm 24 and second arm 26, respectively, of generally U-shaped member 20 as best shown in the embodiments,its in FIGS. 12 and 13. The l-shaped coupling member 44 preferably has a hole 56 for receiving first stud 19. Alternatively, as shown in the embodiments in FIGS. 6–11, the coupling member 44 may also be bent from the same piece of metal as U-shaped member 20.

In the embodiments shown in FIGS. 6–11, guard rail stud adapter 15 has an extension leg 70 preferably integral with arm 24 to provide further support and clearance for adapter 15 in relation to tubes 14. Leg 70 may be formed as part of arm 24 during stamping. It may also be welded or otherwise connected to arm 24 later.

Figure 10:
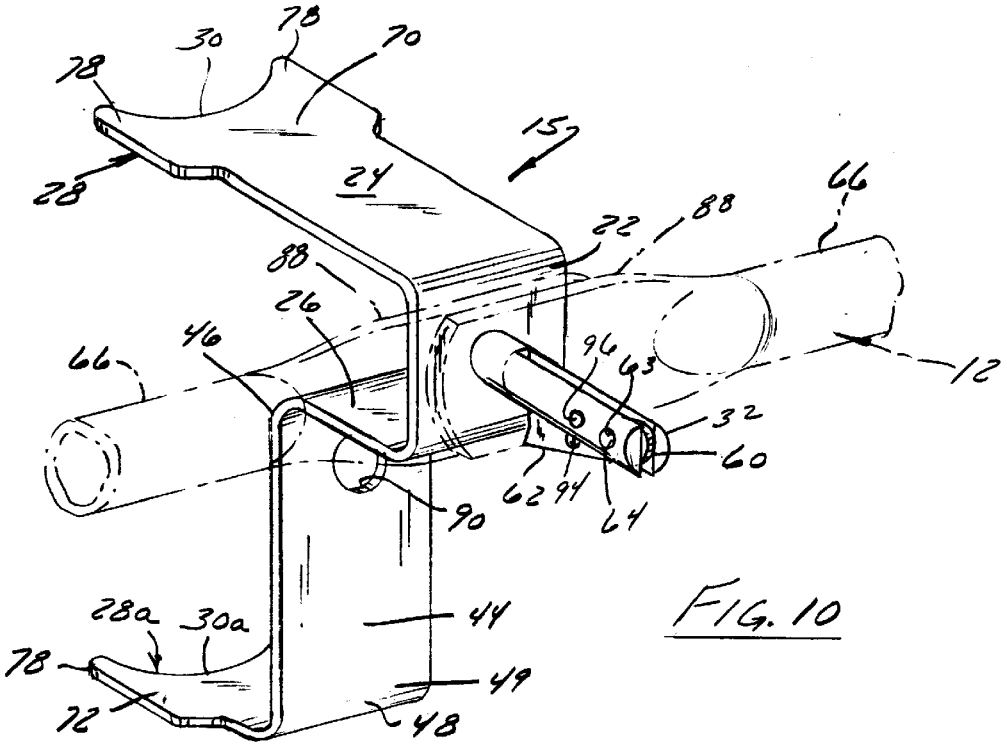
FIG. 10 illustrates an isometric view similar to FIG. 6 showing another embodiment of the adapter of the present invention retaining system members shown in shadow.

As best shown in the embodiments of FIGS. 6 and 10 coupling member 44 may connect only to arm 26 of the U-shaped member 20 at first end 46. In these embodiments, leg 72 extends from second end 48 of coupling member 44 to form an L-shaped member 49.

As shown best in FIGS. 6 and 10, some embodiments of the adapter 15 have a pair of feet 78 at the end of each leg 70, 72. The feet 78 also help adapter 15 better embrace tubes 14, as best shown in FIG. 8. This improved embrace adds additional support and torsion prevention for the adapter 15. In FIG. 10, feet 78 are more pronounced and cut with additional metal stock for added strength.

One preferred embodiment also includes gussets 92 formed on the inside of the U-shaped member 20 to provide further reinforcement of arms 24, 26 relative to the base portion 22 as best shown in FIGS. 6–8. Preferably, gussets 92 are formed on the inside of the U-shaped member 20 by a stamping process. This process also forms a divot of the outer side of U-shaped member 20.

Referring to FIGS. 9 and 10, guard rails 66 and crossed braces 68 preferably include paddles 88, 80, respectively, at each end. Within the paddles 80, 88, are holes 82, 84, respectively, for receiving studs 19, 32 as best shown in FIG. 9.

In the embodiment shown in FIG. 6, ribs 76 are formed in adapter 15 for further reinforcement of the U-shaped and l-shaped members 20 and 44, respectively. Preferably, the ribs 76 extend in the same direction as second stud 32 and provide support for base portion 22 and first arm 24 as shown. In order to ease manufacture, the ribs 76 may be conveniently formed, preferably by cutting and bending from the same slab of metal which forms the l-shaped member 44.

In the embodiments shown in FIGS. 6–11, adapter 15 has a generally central opening 90 to receive first stud 19. In these embodiments, the adapter 15 is largely cut, stamped, and bent from a single piece of metal to form U-shaped member 20, the legs 70, 72 and l-shaped member 44. These parts are generally joined at bends 86 as shown in FIG. 7.

Figure 15:
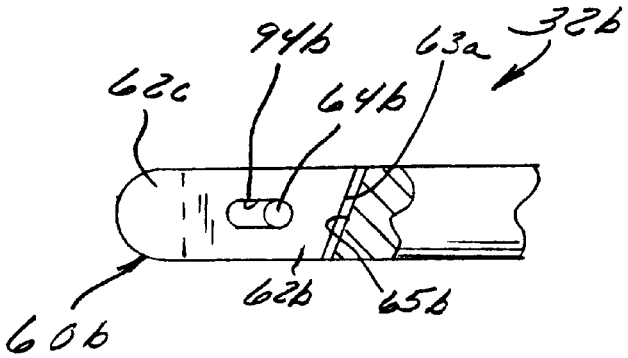
FIG. 15 illustrates an enlarged side view of another embodiment of a stud of the present invention.
Figure 15A:
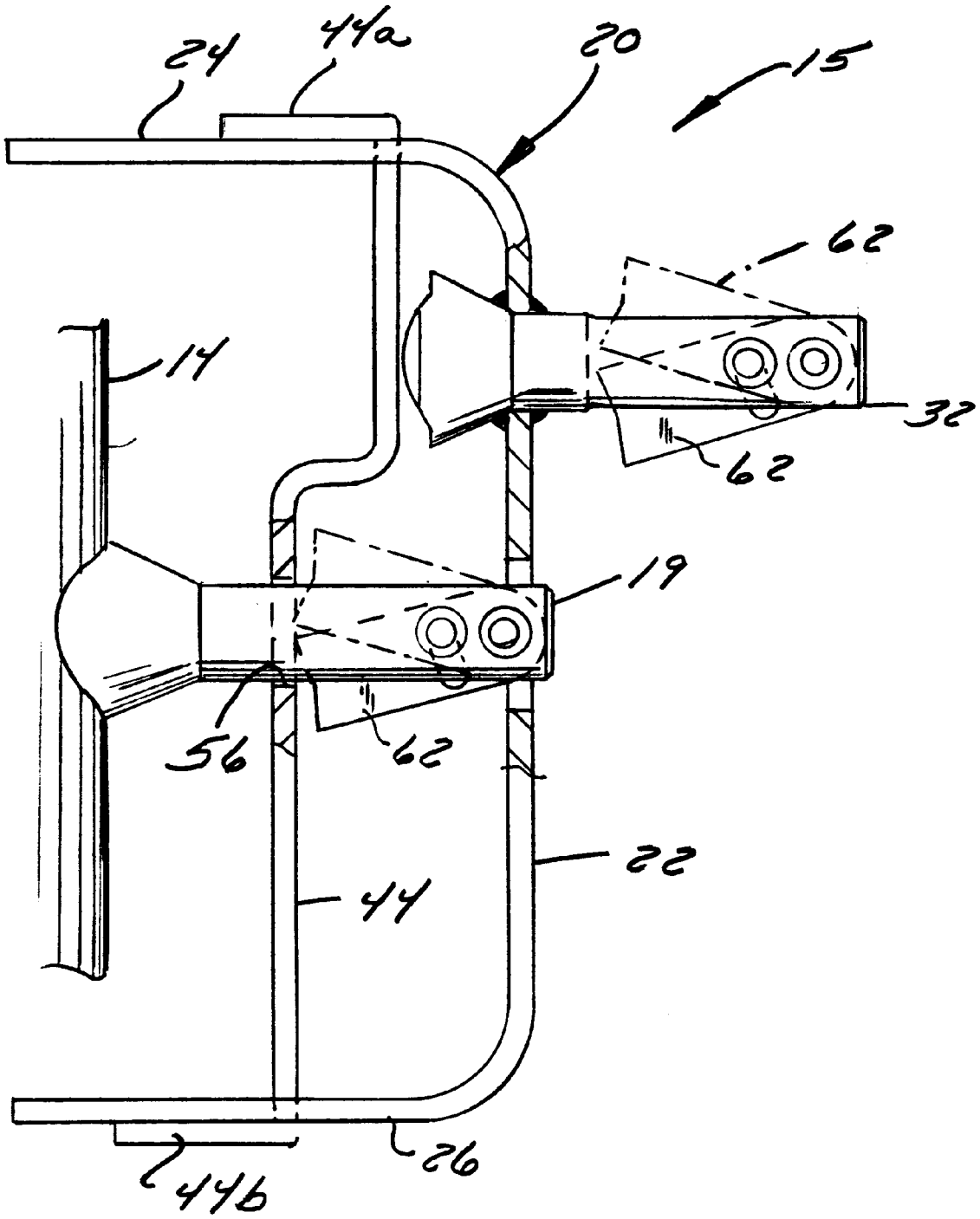
FIG. 15A illustrates a side view of another embodiment of the adapter of the present invention.

Another embodiment is illustrated in FIG. 15A. This embodiment is shaped similar to the embodiment shown in FIG. 13, in that the guard rail stud adapter 15 is comprised of a U-shaped member 20. The generally U-shaped member 20 has base portion 22 and first arm 24 and second arm 26. Between first aim 24 and second arm 26 is coupling member 44. The ends of the coupling member 44*a* and 44*b* are inserted into slots (not shown) in the first and second arms, 24, 26 respectively. Once the ends 44*a* and 44*b* are inserted through the slots they are bent over to retain the coupling member 44 to the U-shaped member 20. Coupling member 44 has generally S-shaped bend and has a hole 56 to receive a first stud 19. A second stud 32 protrudes from the U-shaped member 20 as shown. First stud 19, in addition to receiving the guard rail stud adapter 15 may receive other members such as cross braces (not shown). Similarly, the second stud 32 can receive system members such as guard rails (not shown).

Figure 16A:
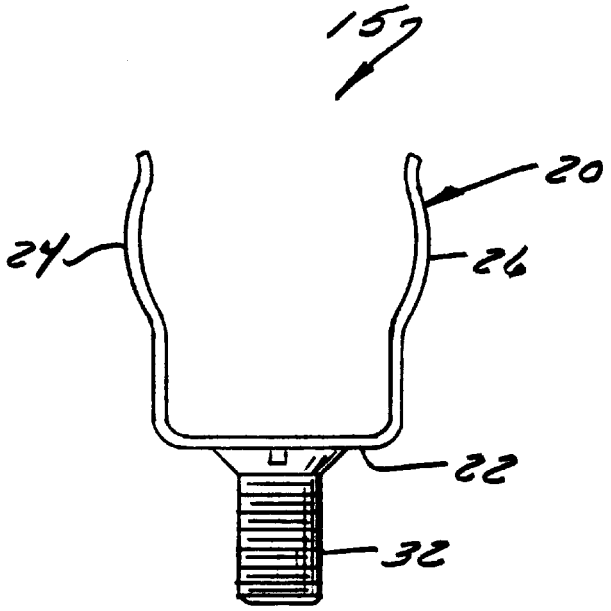
FIG. 16A illustrates a top view of another embodiment of the adapter of the present invention.
Figure 16B:
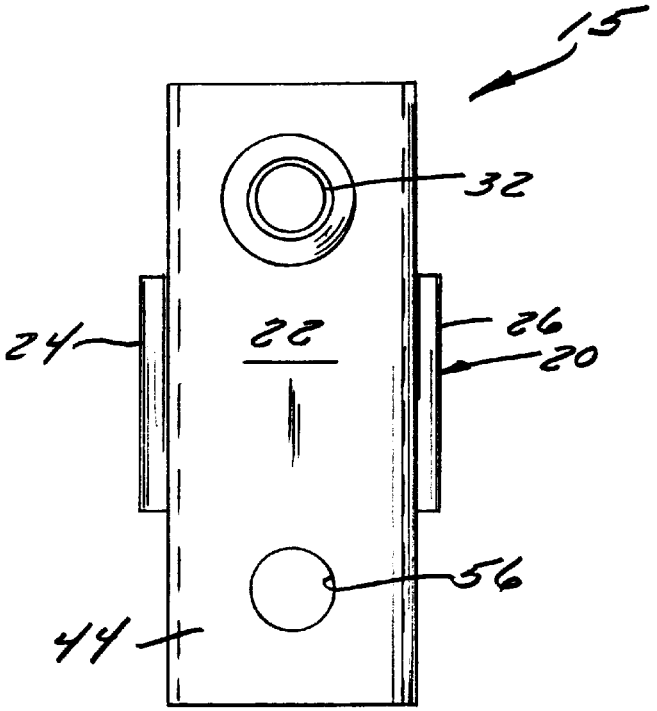
FIG. 16B illustrates a front view of the embodiment of FIG. 16A.

FIGS. 16A and 16B show another alternative embodiment of the present invention. The guard rail stud adapter 15 shown in FIG. 16A has a generally U-shaped portion 20 which includes first arm 24 and second arm 26 extending from base portion 22. Second stud 32 extends outwardly from base portion 22 in a direction opposite the first arm 24 and the second arm 26. As shown in FIG. 16B, hole 56 is provided in coupling member 44 which is integral with base portion 22 to receive an existing first stud (not shown). Arms 24, 26 and base portion 22 are configured to receive a vertical tube (not shown) of a standard scaffolding or shoring system. Arms 24, 26 snugly retain vertical tube to prevent movement of stud adapter 15 when in use.

Figure 17A:
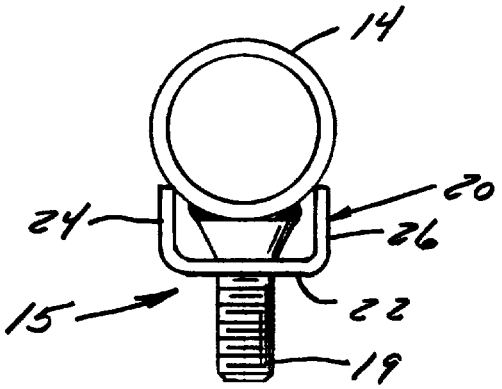
FIG. 17A illustrates a top view of another embodiment of the adapter of the present invention.
Figure 17B:
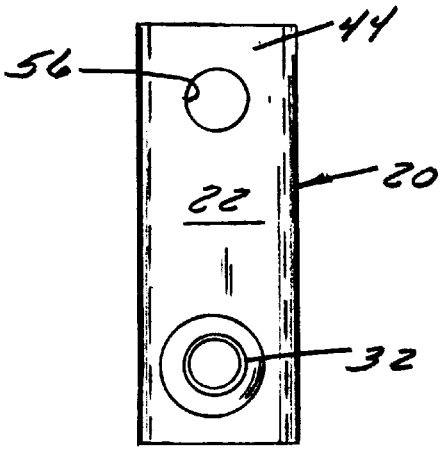
FIG. 17B illustrates a front view of the embodiment of FIG. 17A.
Figure 17C:
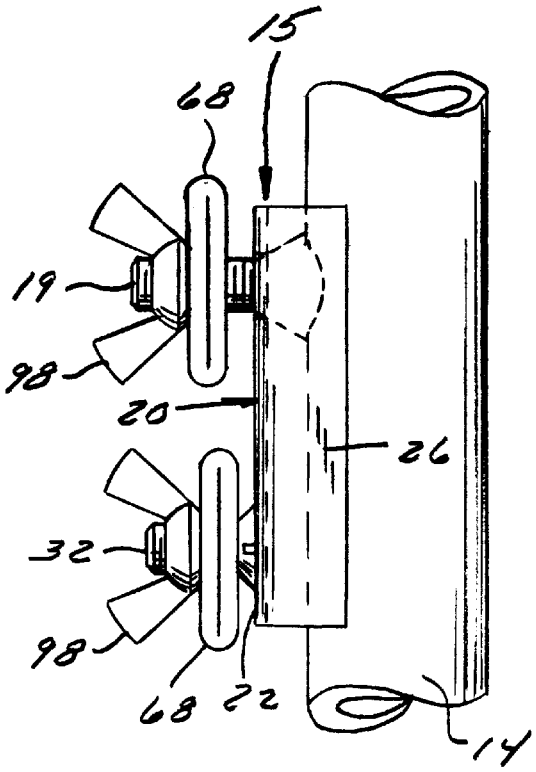
FIG. 17C illustrates a side view of embodiment of FIG. 17A.

Another embodiment of the inventive stud adapter 15 is shown in FIGS. 17A–17C. In that embodiment, as best shown in FIG. 17A, generally U-shaped member 20 has first arm 24 and second arm 26 extending from base portion 22 of guard rail stud adapter 15. Coupling member 44 is integral with base portion 22 has a hole 56 as best shown in FIG. 17B for receiving first stud 19 as best shown in FIG. 17C. As shown in FIG. 17B and 17C, second stud 32 protrudes from base portion 22. As shown in FIG. 17C, guard rail 66 and braces 68 as well as other members may be attached to the studs 19 and 32. As mentioned above, the members may be secured to studs 19, 32 by alternative means such as wing nuts 98 as shown in FIG. 17C.

In one embodiment of a stud 32*b* as shown in FIG. 15, wing 62*b* of locking wing latch 60*b* has a generally oval-shaped hole 94*b* connected with roll pin 64*b*. As shown in FIG. 15, wing 62*b* can only pivot in a downward direction due to the generally upwardly sloping shape of the end 63*a* of the wing 62*b* and the downwardly sloping shape of slot 65*b* in stud 32*b*. Wing 62*b* can also slide up and down for ease of engagement and disengagement when in use because of the generally exaggerated dimensions of hole 94*b*. Gravity tends to pull the wing 62*b* downwardly thus automatically retaining a paddle because there is more material and more weight at second end 62*c* than at end 63*a*.

The locking wing latch 60, 60*a*, 60*b* of the present invention is designed to allow ease of detachment and reattachment of cross braces 68 or guard rails 66 by the user of the system 5 especially in dangerous environments or hazardous environments high off the ground. However, other configurations are imaginable to secure the scaffolding members 66, 68 to studs 19 and 32. For example, these configurations are described in U.S. Pat. Nos. 3,751,081; 4,111,579; 2,832,649; 3,867,043; 5,186,568; and 2,698,552 incorporated herein by reference.

In operation as best shown in FIG. 7. one embodiment of the guard rail stud adapter 15 is first attached to system 5 by being placed over existing first stud 19 (in shadow) which protrudes from upright vertical tube 14 (also in shadow). As best shown in FIGS. 9 and 11, system members 12 such as crossed braces 68 are slid over existing first stud 19. Then the guard rail stud adapter 15 is slid in place. The holes 82 in the paddles 80 of crossed braces 68 and hole 90 of the adapter 15 are properly dimensioned and configured to receive first stud 19 as best shown in FIG. 9. U-shaped member 20 is configured and dimensioned in such a manner to allow the cross braces 68 to be retained without interference. Preferably on stud 19, locking wing latch 60*a* then drops into position to retain the members to the guard rail stud adapter 15. In this manner, the guard rail stud adapter 15 and crossed braces 68 are safely retained to system 5. Alternatively, locking latch 60*a* may be moved by hand as is known in the art.

Once the guard rail stud adapter 15 is in place, protruding second stud 32 may be used to retain guard rails 66 as best shown in FIGS. 9 and 11. Paddles 88 of guard rail 66 have holes 84 dimensioned and configured for receiving, second stud 32 of adapter 15. Once second stud 32 is placed in hole 84 of paddle 88, wing 62 of locking wing latch 60 drops downwardly to retain paddles 88. In one embodiment, this is accomplished by moving locking wing 62*b* downwardly as best shown in FIG. 15. In another embodiment, best shown in FIG. 15A the wing 62 can be moved either upwardly or downwardly.

Preferably, the embodiment of inventive guard rail stud adapter 15 shown in FIG. 6 is about 5½ inches from first end 28 to second end 28*a*. It measures about 1¾ inches along each end 28, 28*a*. From the tip of first end 28 to the base 22 of U-shaped member 20, the guard rail stud adapter 15 measures about 3 inches. From the tip of the second end 28*a* to the connection point of the l-shaped member 44, the leg 72 measures about 1¾ inches. First stud 19 and second stud 32 measure about 1¾ inches. The diameter of the opening 90 and hole 56 is about 17/32 inches.

In the embodiments shown in FIGS. 6–11, the distance between arms 24, 26 is about 1½ inches. In the embodiment shown in FIGS. 12 through 14, the distance between arms 24, 26 is about 5 inches. The diameter of the recess located at the ends 28, 28*a* of the legs 70, 72 is about 1 23/32 inches. The guard rail stud adapter 15 is preferably stamped from a single piece of plate steel about ⅛ of an inch thick. The embodiments of FIGS. 15A–17C are similarly dimensioned.

Although the disclosed embodiments show gussets 92 and ribs 76 as structures for performing the function of strengthening the adapter 15, the structure for strengthening can be any other structure capable of strengthening the adapter 15, including, by way of example, a weldment or some other suitable structure.

Although the best mode contemplated by the inventors of carrying out the present invention is disclosed above, practice of the present invention is not limited thereto. It will be manifest that various other additions, modifications and rearrangements of the features of the present invention may be made without deviating from the spirit and scope of the underlying inventive concept.

For example, the adapter of the present invention can be made of any suitable rigid material. However, for the preferred stamping manufacturing operation mentioned above, it is an advantage to employ a metal material. Similarly, although metal or steel is preferred for the stud any material could be used in its place. In addition, other individual components need not be fabricated from the disclosed materials, but could be fabricated from virtually any suitable material.

Moreover, the individual components need not be formed in the disclosed shapes, or assembled in the disclosed configuration, but could be provided in virtually any shape, and assembled in virtually any configuration. Furthers although the adapter described herein is a physically separate module, it will be manifest that the adapter may be integrated into the guard rail or cross brace with which it is associated. Furthermore, all the disclosed features of each disclosed embodiment can be combined with, or substituted for, the disclosed features of every other disclosed embodiment except where such features are mutually exclusive.

It is intended that the appended claims cover all such additions, modifications and rearrangements.

We claim:

1. A scaffolding system comprising:

a) a vertical tube having a first stud protruding outwardly therefrom;

b) a cross brace having a hole therethrough receiving the first stud;

c) a stud adapter including a second stud protruding therefrom said stud adapter comprising a generally U-shaped member including a base portion, a first and second arm connected to the base portion, a coupling member having a first end connected to at least one of the arm, and a hole in said coupling member receiving said first stud; the first and second studs each comprising a locking wing latch, the latch including a wing having a hole and a roll pin for swingably connecting the wing to the stud; the first stud locking wing latch locking the coupling member and the cross brace to the first stud, and the second stud locking wing latch locking a guard rail to the second stud.

2. The adapter of claim 1 further comprising a spacer having a counter-bore for receiving the first stud of the system the spacer connected between the second stud and the generally U-shaped member, and the generally U-shaped member having a hole aligned with the counter-bore of the spacer.

3. The adapter of claim 1, wherein at least one of the arms includes an end having a recessed portion for receiving a vertical tube.

4. The adapter of claim 2, wherein the spacer is generally square-shaped and welded to the generally U-shaped member.

5. The adapter of claim 1, wherein the second stud protrudes in a direction opposite the arms.

6. The adapter of claim 1, further comprising at least one rib extending in the same direction as the second stud for providing support to the generally U-shaped member.

7. The adapter of claim 1, further comprising a pair of feet extending outwardly toward the system from the arms for embracing the system.

8. The adapter of claim 1, further comprising a leg extending from the coupling member to form an L-shaped member.

9. The adapter of claim 1, wherein the adapter is generally formed by welding the second stud to a single plate of metal which has been formed into a U-shaped member by punching.

10. The adapter of claim 1, further comprising at least one rib integral with the generally U-shaped member for reinforcing the adapter.

11. The adapter of claim 1, wherein the coupling member forms an L-shaped member.

12. The adapter of claim 1, wherein the adapter is generally formed by bending.

13. The adapter of claim 1, further comprising a leg formed from the generally U-shaped member by stamping.

* * * * *

UNITED STATES PATENT AND TRADEMARK OFFICE

CERTIFICATE OF CORRECTION

PATENT NO. : 6,062,341
DATED : May 16, 2000
INVENTOR(S) : Roger Frank, et al.

It is certified that error appears in the above-indentified patent and that said Letters Patent is hereby corrected as shown below:

On the Title page, second column item [57] ABSTRACT, line 16: Replace "Tile" with -- The--.

Column 1, line 14: Replace "shoring(g" with --shoring--.

Column 9, line 4: Replace "Furthers" with --Further,--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*